US005544515A

United States Patent [19]

Zwiechowski

[11] Patent Number: 5,544,515

[45] Date of Patent: Aug. 13, 1996

[54] METHOD OF AND APPARATUS FOR THE FORMATION OF THE CIGARETTE BLOCKS

[75] Inventor: Jurgen Zwiechowski, Schwelm, Germany

[73] Assignee: Maschinenfabrik Alfred Schmermund GmbH & Co., Gevelsberg, Germany

[21] Appl. No.: 358,839

[22] Filed: Dec. 19, 1994

[30] Foreign Application Priority Data

Dec. 22, 1993 [DE] Germany ..... 43 43 803.2

[51] Int. Cl.[6] ..... B65B 19/04

[52] U.S. Cl. ..... 53/148; 53/151

[58] Field of Search ..... 53/147, 148, 149, 53/150, 151, 444

[56] References Cited

U.S. PATENT DOCUMENTS 688,284 12/1901 Bilgran et al. ..... 53/149
1,899,898 5/1931 Molins et al. ..... 53/150
4,096,682 6/1978 Sheahan ..... 53/149
5,201,162 4/1993 Focke ..... 53/151
5,375,392 12/1994 Oberdorf ..... 53/149

*Primary Examiner*—John Sipos
*Assistant Examiner*—Ed Tolan
*Attorney, Agent, or Firm*—Chilton, Alix & Van Kirk

[57] ABSTRACT

Relatively fragile articles, such as cigarettes, are formed into blocks consisting of three rows with a middle row containing one cigarette less than the outer rows. The cigarettes in the middle row are also laterally offset by approximately one-half the diameter of a cigarette from the cigarettes in the outer rows as a result of forming the blocks in a linear array of feed shafts which, from a lower support surface, extend upwardly at an angle other than perpendicular. A shaft disposed at one end of the array is closed at the level of the lower two rows and a multi-armed block slide is provided for pushing the cigarettes which define the block from an extraction zone, located at the bottom of the shafts, into a receiver.

19 Claims, 3 Drawing Sheets

METHOD OF AND APPARATUS FOR THE FORMATION OF THE CIGARETTE BLOCKS

BACKGROUND OF THE INVENTION

The present invention relates to the formation of "blocks" consisting of three rows of loose, identically shaped articles such as cigarettes, the middle row containing one article less than the abutting outer rows. More particularly, this invention is directed to apparatus for use in the grouping of loose cigarettes into "blocks" having an even number of cigarettes arranged in an odd number of rows and, especially, to cigarette block forming apparatus including an angularly oriented, linear array of feed shafts with the number of shafts corresponding to the maximum number of cigarettes in any of the rows of the block to be formed increased by one, one of the end shafts of the array terminating at the level of the bottom of the uppermost row. Accordingly, the general objects of the present invention are to provide novel and improved methods and apparatus of such character.

DESCRIPTION OF THE PRIOR ART

While not limited thereto in its utility, the present invention is primarily intended for use in the packaging of cigarettes and, particularly, in the formation of cigarettes into "blocks" for subsequent packaging. Cigarettes are relatively fragile articles and, accordingly, must be treated gently during the formation into a "block" having the requisite size, shape and number of cigarettes for the package to be formed.

Exemplary prior art methods of and apparatus for grouping cigarettes into blocks for subsequent packaging are disclosed in U.S. application Ser. No. 08/022,076. In the technique described in this co-pending and commonly assigned application, the cigarettes to be formed into blocks are delivered to substantially vertically oriented shafts defined by spaced walls which extend from a bottom member. A lateral shaft located in the position corresponding to the middle row of the cigarette block to be formed is closed by a web. The prior art apparatus also comprises a device for feeding a cigarette under the web thus defining three rows of cigarettes with the middle row comprising one less cigarette than the other two rows. The three rows of cigarettes are ejected from an extraction region at the bottom of the shafts by means of a block slide. The cigarettes to be pushed out of the shafts by the block slide are, in the three rows, vertically aligned. The vertically aligned cigarettes in the lateral shaft which includes the web are separated by the diameter of a cigarette. Accordingly, after emerging from the shafts, the rows have to be displaced into the requisite mutually offset position, row-to-row, and pressed together. This requires the application of a compacting force to the grouped cigarettes from all four sides. Despite the relatively careful extraction and compaction operation, there is a residual possibility of damage to the individual cigarettes, i.e., the possibility of faults in the block forming procedure cannot be excluded.

A further example of a prior art cigarette block forming apparatus may be seen from German Patent Publication DE-C-2,453,625. The latter publication discloses apparatus comprising, on each side, three horizontally terminating shafts from which are fed a number of cigarettes corresponding to the requisite number for the one of three horizontal rows of a block to be formed. In this apparatus, two middle cigarettes of the three rows are provided via two vertical shafts. These vertical shafts are obliquely oriented such that the bottom most and top most rows, reversed relative to one another, include one cigarette more to be pushed out on these two shafts than on the other side. This arrangement results in the cigarettes being offset relative to one another in the horizontal rows. However, the vertical spacings between the cigarettes resting against one another in the horizontally terminating shafts are nevertheless necessarily considerable, whereas there is no vertical spacing between the cigarettes and the shafts which terminate obliquely vertically. The cigarettes in the latter shafts, however, are separated from one another in the vertical direction. Accordingly, during the extraction operation, forces still have to be exerted on the grouped cigarettes from all four sides and the spacings between the individual cigarettes have to be reduced to a considerable degree. The potential for faults in the block forming procedure thus exists.

SUMMARY OF THE INVENTION

The present invention overcomes the above-briefly discussed and other deficiencies and disadvantages of the prior art and, in so doing, provides a technique for the formation of multi-rowed groups of fragile articles, and particularly cigarettes, in a manner which ensures extremely careful treatment of the articles during the group formation. The invention also encompasses apparatus for implementing the aforementioned technique wherein, in an extraction region at the base of an array of shafts down which cigarettes or other articles to be packaged descend under the influence of gravity, the shafts extend obliquely relative to a common bottom member. Where the grouped articles or block is comprised of three rows, apparatus in accordance with the present invention further includes, at one end of the array of shafts, an outer shaft in which the positions of the two lower rows are closed. This closure, in combination with the employment of a number of shafts which corresponds to the maximum number of cigarettes in any of the rows increased by one, results in the cigarettes being positioned in the lower three rows at horizontal locations commensurate with the requisite offset relationship between the rows which will characterize the cigarette block to be formed and subsequently wrapped.

Apparatus in accordance with the present invention thus comprises a shaft arrangement which results in cigarettes in the three rows at the base of the shafts being staggered from row to row. Accordingly, the dimension of the cigarette block in the vertical direction is substantially already formed by the feed shaft arrangement. Therefore, when the cigarettes comprising the block are pushed out of the extraction region of the array of shafts, the only requisite further compaction may be accomplished by pressing the formation together from the two narrow sides. Accordingly, the cigarettes are handled gently and the possibility of faults occurring during the block forming process is minimized.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE ENCLOSED EMBODIMENTS

Figure 1:
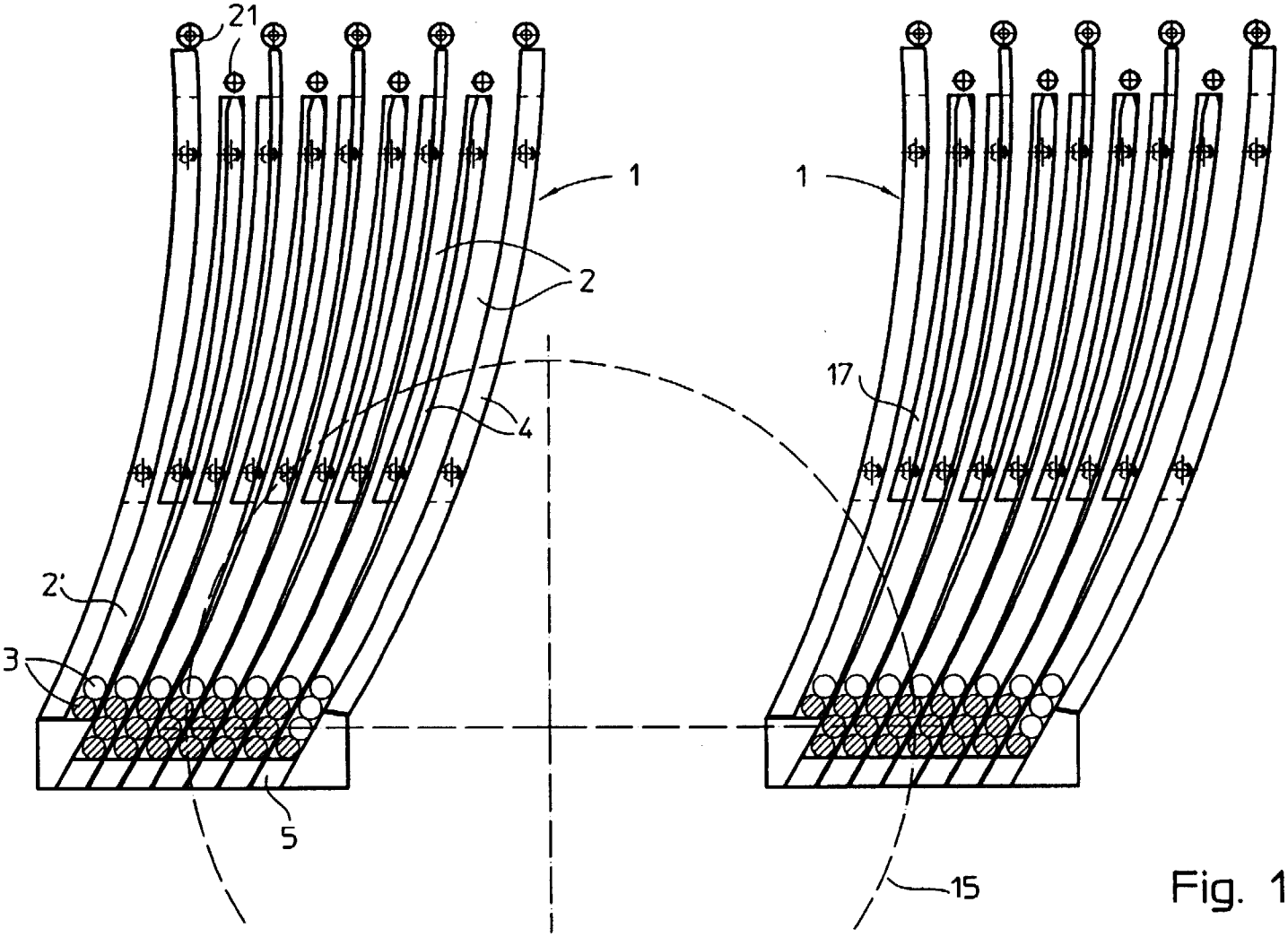
FIG. 1 is a schematic, front elevational view of a feed shaft arrangement for apparatus for use in the formation of three row cigarette blocks in accordance with the invention.

With reference now to the drawings, FIG. 1 schematically illustrates a pair of cigarette funnels, indicated generally at 1, each of which includes eight feed shafts 2. The shafts 2 will have a minimum width which is somewhat wider than the diameter of the cigarettes 3 which are to be formed into blocks for subsequent packaging. The shafts 2 are defined by shaft walls 4 which are widened conically towards the upper entry end thereof, the cigarettes descending toward the common bottom 5 of the shafts 2 under the influence of gravity. In accordance with the embodiment of FIG. 1, the shafts 2, and thus also the shaft walls 4, are curved and terminate, at their upper ends, at a position which is angularly displaced relative to their bottom ends by an angle of approximately 40°. This curved shaft orientation, i.e., the oblique offsetting of the top and bottom ends of the feed shafts 2, results in the lower three rows of cigarettes 3, as indicated by cross-hatching, being arranged offset relative to one another. Restated, proceeding upwardly from the row of cigarettes which rests on the bottom 5 of the funnels 1, each row of cigarettes is staggered relative to the adjacent lower row by approximately one-half of the diameter of a cigarette. Accordingly, prior to being extracted from the funnels, the cigarettes are already arranged essentially according to the desired arrangement in the finished, i.e., compacted, cigarette block. This desirable offset arrangement of cigarettes, in part, results from the fact that an end shaft 2' of the array of shafts is, at the levels of the two lowermost rows in the funnel, closed. Accordingly, proceeding upwardly from bottom 5, there are seven cigarettes 3 located in each of the two lower rows of the funnel and eight cigarettes located in the third row.

Figure 3:
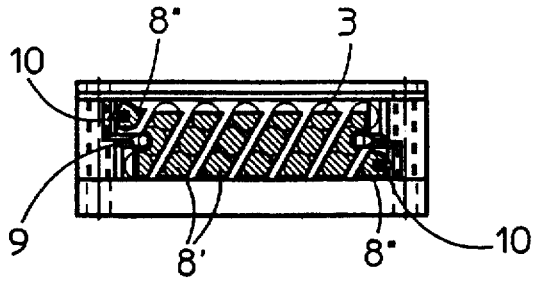
FIG. 3 is a cross-sectional view depicting the extraction of a block of cigarettes from the shaft arrangement of FIG. 1 and the feeding of the extracted block into the block receptacle of FIG. 2.
Figure 2:
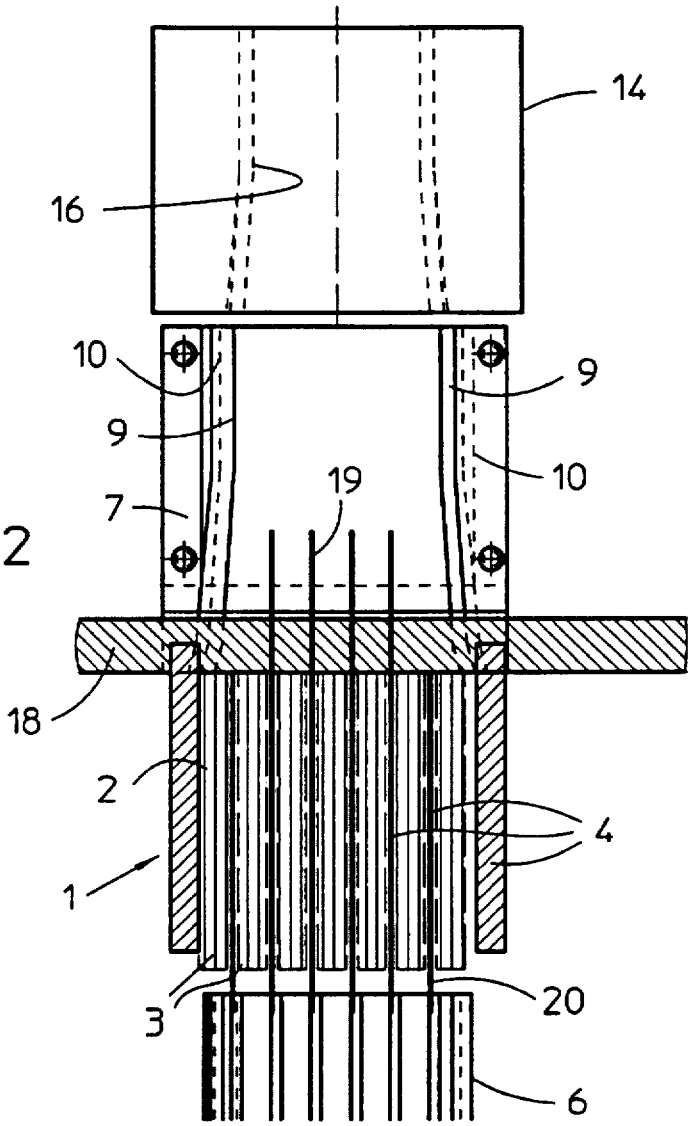
FIG. 2 is a cross-sectional top view of block forming apparatus which includes the feed shaft arrangement of FIG. 1.
Figure 4:
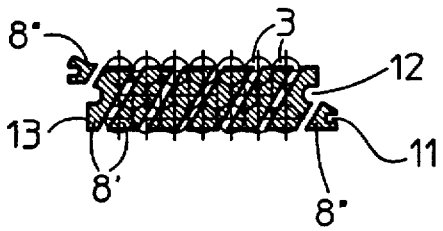
FIG. 4 is a view similar to FIG. 3 which more clearly shows the block slide which controls the extraction operation.

Referring to FIGS. 2–4, the twenty cigarettes 3 which customarily define a cigarette block are pushed out of the lower, i.e., three row, extraction region of the funnels 1, and into a block receptacle 7, by means of a block slide 6. The block slide 6 includes six slide portions 8' which are in the form of parallelogram shaped, blade-like arm extensions. The slide portions 8' are obliquely arranged so as to be complimentary to the bottom portions of the cooperating shafts 2, i.e., the slide portions 8' pass through the shafts 2 and, in so doing, push the cigarettes in the lower three rows into the block receptacle 7. The block slide 6 further includes, on each of the outer sides thereof, a slide portion 8" sized and shaped for pushing an individual cigarette 3 out of end shaft 2' and the oppositely disposed outer shaft 2.

The block receptacle 7 narrows, in the direction in which the cigarettes extracted from the funnel 1 are pushed, in order to compact the block of cigarettes. Block receptacle 7 includes, on each of the two opposite sides thereof, a projecting web 9 which extends in the travel direction of the cigarettes. The webs 9 are located at the appropriate level so as to occupy the lateral free spaces at the ends of the middle of the three rows, i.e., the row which consists of only six cigarettes. A pair of further guide webs 10 are provided, as may best be seen from FIG. 3, which extend parallel to the webs 9. One of the guide webs 10 is arranged below an adjacent web 9, i.e., at the level corresponding to a portion 8" of the block slide 6. The other, oppositely disposed, guide web 10 is arranged above the adjacent web 9 at the level of the other slide portion 8". The guide webs 10 have a smaller width when compared to the webs 9 and, at the entry end of the block receptacle 7, do not restrict the entry for the two individual cigarettes which are pushed out of the funnel by means of the block slide portions 8". Restated the guide webs 10 are, at their upstream ends in the direction of cigarette travel, flush with the adjacent feed shaft walls 4.

The portions 8" of the block side 6 are each provided with a cut-out 11 for receiving an associated guide web 10. The two outer block slide portions 8', as best seen from FIG. 4, are also provided with a cut-out 12 for receiving an associated web 9. The outermost portions of the block slide, i.e., the portions located closest to the converging walls of a block receptacle 7, are also provided with a chamfer as indicated at 13. The provision of such a chamfer makes it possible for the outwardly disposed portions of the block slide to be pushed through the block receptacle despite the narrowing passage defined thereby.

The block receptacle 7 can be a stationary "switch" or coupling or may be a movable pocket. If block receptacle 7 is stationary, it may serve as a mouthpiece for a cell 14 of a turret, shown schematically in FIG. 1, or a belt conveyor. Such a cell will conventionally be provided with a reception region 16 for the cigarette block. The cells are narrowed, in the direction of cigarette block movement, in order to press the cigarettes together to the desired extent. In the case of a stationary block receptacle 7, the block slide 6 will be employed to push the block of cigarettes through the block receptacle 7 and into the cell 14, the turret comprising the cell forming part of the packaging machinery.

FIG. 3 is a view showing the entry side of block receptacle 7, as seen from a cigarette funnel 1. FIG. 4 may be considered a view, looking into the cell 14, of the block slide 7 and the cigarettes being propelled thereby.

Referring again to FIG. 1, each of the shaft defining walls 4 may be provided with a leg or flange 17 which extends in a plane perpendicular to the axes of cigarettes disposed in the shafts 2. The flanges 17 provide means for securing the walls 4 to a rear wall 18, as shown in FIG. 2, of a funnel 1.

FIG. 2 shows that some of the shaft defining walls 4, the four middle walls in the exemplary embodiment illustrated, may be provided with tabs or finger-like extensions 19 which project partially into the block receptacle 7. These tabs 19 support the cigarette block during the movement thereof from the funnel into the block receptacle. The shaft defining walls 4 may also have tabs 20 which function as block slide guide extensions, i.e., tabs 20 extend into a block slide 6 in its initial or rest position.

Figure 5:
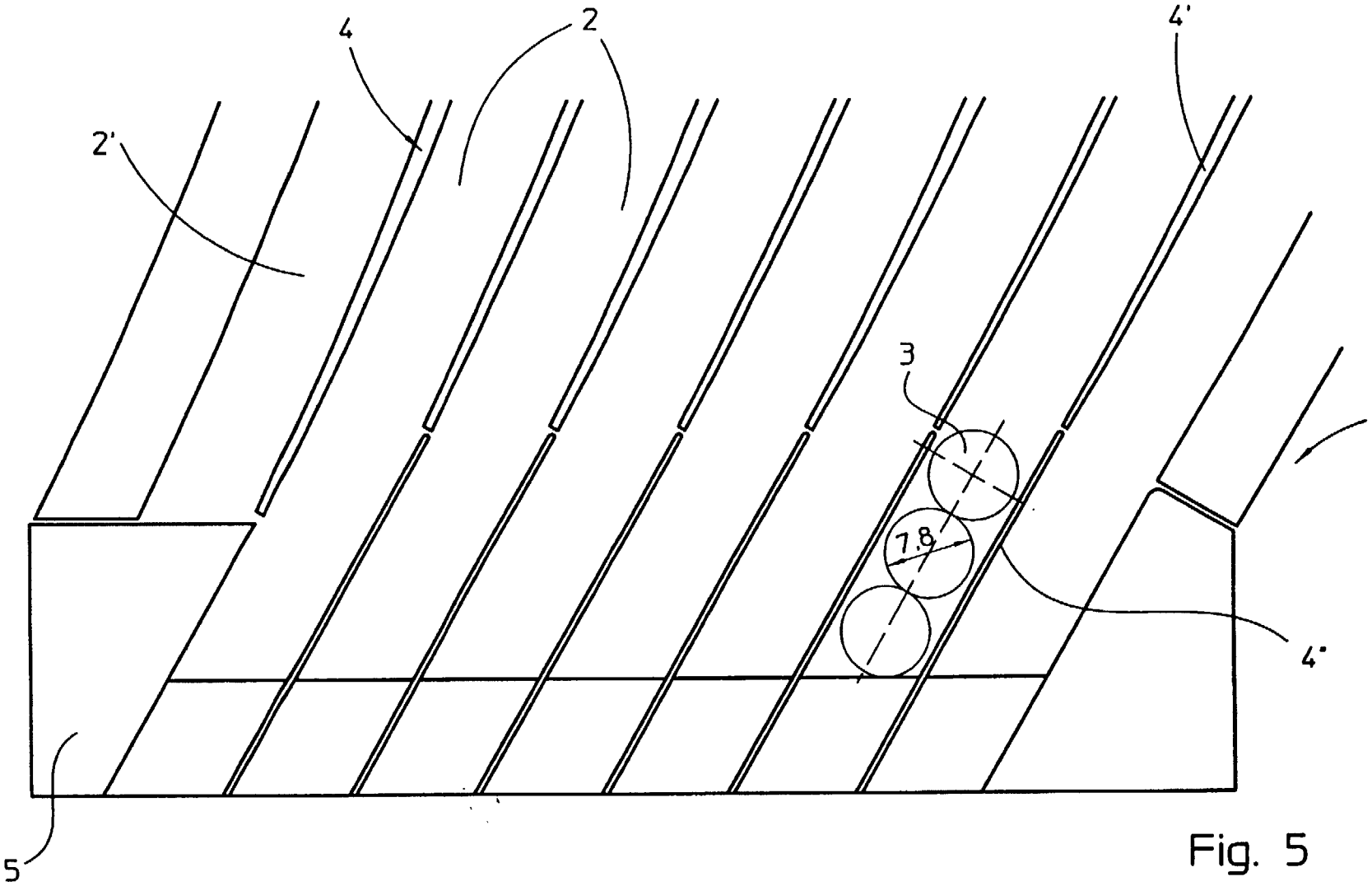
FIG. 5 is an enlarged schematic view, similar to FIG. 1, which shows an alternative cigarette feed shaft arrangement in accordance with the invention.

The shaft defining walls 4 may, for example, be terminated half a cigarette diameter above the bottom member 5. Also, referring to the alternate arrangement of FIG. 5, the walls 4 may be formed in two parts, i.e., a curved upper conical portion 4' and a straight lower portion 4". In the FIG. 5 arrangement, the lower ends of the upper portions 4' of the shaft defining walls terminate in a plane which is level with the top of the third row of cigarettes. The lower portions 4"

are supported separately from the upper portions 4'. As schematically shown in FIG. 5, the lower wall portions 4" are engaged in receiving apertures in the bottom member 5. The lower portions 4" may also be lengthened to form the tabs 19, 20.

Referring again to FIG. 1, vibrating rollers 21 are located at the upper ends of the shaft defining walls 4 in order to assist the entry of the cigarettes into the shafts 2 and the subsequent movement of the cigarettes downwardly along the shafts 2. As may also be seen from FIG. 1, it has been found expedient to terminate the shaft defining walls 4 alternatively at two difference heights.

As will be obvious to those skilled in the art, rather than forming cigarette blocks of twenty cigarettes each as represented in the disclosed embodiments, any formation consisting of three rows with the x+1, x and x+1 cigarettes can be formed. Similarly, the present invention can be employed where the articles being processed are to be arranged in more than three rows. In such an arrangement, every second row will contain one article less than the adjacent rows, and a further shaft 2 is required for every two additional rows. Likewise, the block slide 6 will be modified so as to have slide portions 8" for pushing the bottom most cigarette out of the outer shafts at each level.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In an apparatus for the formation of cigarette blocks consisting of at least three rows of cigarettes, the middle one of such three rows containing one cigarette less than the other rows, the apparatus having an array of feed shafts defined by shaft walls which are spaced from one another, the number of shafts corresponding to the maximum number of cigarettes in any one of the rows increased by one, the shafts having a width larger than the diameter of the cigarettes being formed into blocks whereby cigarettes may be delivered to and travel down the shafts so as to be arranged one above the other in the shafts, the apparatus further having a block receptacle and a block slide for simultaneously pushing a number of rows of cigarettes commensurate with the size of the cigarette block to be formed out of a lower extraction region of the shafts into the block receptacle, the extraction region extending upwardly from a shaft bottom, the block receptacle defining a passage, the improvement comprising:

at least the lower ends of the shafts extending upwardly at an angle other than perpendicular relative to the shaft bottom, the outermost shaft of the array at one end thereof having means for closing the two lower rows whereby the rows of cigarettes proceeding upwardly from the lowermost row will be offset to one another, row-to-row accordingly to their arrangement in the cigarette block to be formed;

the block receptacle defined passage having fixed dimensions; and at least some of the shaft defining walls being provided with extensions which project into the passage defined by the block receptacle.

2. The apparatus of claim 1 wherein the block receptacle is stationary and the passage defined thereby narrows in the direction of cigarette block movement produced by the block slide, said passage having a discharge end, and wherein the apparatus further comprises a first receiving cell of a block conveying device which may be brought into registration with said discharge end of said block receptacle passage.

3. The apparatus of claim 2 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

4. The apparatus of claim 2 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

5. The apparatus of claim 1 wherein the block receptacle is a movable pocket.

6. The apparatus of claim 1 wherein the improvement further comprises segmented shaft defining walls, said segmented walls each including at least a lower shaft wall in the extraction region and a generally conical shaped shaft wall above the extraction region.

7. The apparatus of claim 1 wherein the shaft defining walls are terminated at a position adjacent to but above the shaft bottom.

8. The apparatus of claim 1 further comprising:

means for imparting vibration to the upper ends of the shaft defining walls.

9. The apparatus of claim 1 wherein the upper ends of the shaft defining walls are of different height.

10. The apparatus of claim 5 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

11. The apparatus of claim 6 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

12. The apparatus of claim 2 wherein the improvement further comprises segmented shaft defining walls, said segmented walls each including at least a lower shaft wall in the extraction region and a generally conical shaped shaft wall above the extraction region.

13. The apparatus of claim 12 further comprising:

means for imparting vibration to the upper ends of the shaft defining walls.

14. The apparatus of claim 13 wherein the upper ends of the shaft defining walls are of different height.

15. The apparatus of claim 12 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

16. The apparatus of claim 13 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

17. The apparatus of claim 14 wherein the block receptacle further comprises oppositely disposed guide webs which project into the lateral free spaces of the middle row of the block of cigarettes, the middle row consisting of one less cigarette than the adjacent rows, and wherein the block receptacle further includes guide webs for cooperating with the block slide, said guide webs being configured so as to be flush with the adjacent shaft defining wall at the entrance end of the block receptacle.

18. The apparatus of claim 12 wherein said lower shaft walls are linear and parallel.

19. The apparatus of claim 1 wherein the shaft defining walls are smoothly curved from the bottom ends thereof to laterally offset top shaft entrance defining ends thereof.

* * * * *

UNITED STATES PATENT AND TRADEMARK OFFICE

CERTIFICATE OF CORRECTION

PATENT NO. : 5,544,515

DATED : August 13, 1996

INVENTOR(S) : Jurgen Zwiechowski

It is certified that error appears in the above-indentified patent and that said Letters Patent is hereby corrected as shown below:

Column 5, line 57, insert a comma after "row-to-row" and change "accordingly" to --according--.

Column 6, line 14, change "2" to --1--.

Signed and Sealed this

Twenty-sixth Day of November 1996

*Attest:*

Bruce Lehman

BRUCE LEHMAN

*Attesting Officer*

*Commissioner of Patents and Trademarks*